US005977466A

United States Patent [19]

Muramatsu

[11] Patent Number: 5,977,466

[45] Date of Patent: Nov. 2, 1999

[54] KEYBOARD MUSICAL INSTRUMENT EQUIPPED WITH SMALL SIMPLE ECONOMICAL KEY TOUCH GENERATOR

[75] Inventor: Shigeru Muramatsu, Shizuoka, Japan

[73] Assignee: Yamaha Corporation, Japan

[21] Appl. No.: 08/890,103

[22] Filed: Jul. 9, 1997

[30] Foreign Application Priority Data

Jul. 11, 1996 [JP] Japan ..... 8-182365

[51] Int. Cl.[6] ..... G10H 1/32; G10H 1/34

[52] U.S. Cl. ..... 84/440; 84/718; 84/720; 84/743; 84/745; 84/433; 84/439

[58] Field of Search ..... 84/718–720, 743–745, 84/423 R, 424, 433, 440, 439

[56] References Cited

U.S. PATENT DOCUMENTS 5,763,799 6/1998 Kimble ..... 84/433
5,783,765 7/1998 Muramatsu ..... 84/615

FOREIGN PATENT DOCUMENTS 4-204697 7/1992 Japan .
7-99475 10/1995 Japan .
7-111631 11/1995 Japan .

*Primary Examiner*—Robert E. Nappi
*Assistant Examiner*—Marlon T. Fletcher
*Attorney, Agent, or Firm*—Ostrolenk, Faber, Gerb & Soffen, LLP

[57] ABSTRACT

An electronic keyboard musical instrument includes a plurality of keys turnable between a rest position and an end position, an electronic sound generating system responsive to the motion of the key so as to generate an electronic sound and a key touch generator for offering resistance against the motion of the key, and the key touch generator has a magnetic plate attached to a side surface of each key, a stationary electromagnetic actuator generating electromagnetic force so as to attract the magnetic plate thereto and a controller responsive to a key position signal representative of a current key position so as to change the magnitude of a driving signal supplied to the electromagnetic actuator, thereby varying the resistance like the key of an acoustic piano.

19 Claims, 7 Drawing Sheets

KEYBOARD MUSICAL INSTRUMENT EQUIPPED WITH SMALL SIMPLE ECONOMICAL KEY TOUCH GENERATOR

FIELD OF THE INVENTION

This invention relates to a keyboard musical instrument and, more particularly, to a keyboard musical instrument equipped with a key touch generator for exerting load variable like that of an acoustic piano.

DESCRIPTION OF THE RELATED ART

Manufacturers presently offer various kinds of keyboard musical instruments such as an acoustic piano and an electronic keyboard to musicians, and these keyboard musical instruments have different key touches.

The electronic keyboard has a plurality of turnable keys urged to respective rest positions by means of spring members, and sensors monitor the keys to see whether or not a player depresses them. When a musician depresses a key, the key is moved from the rest position toward the end position against the resilient force of the spring member, and the associated key sensor produces a key position signal representative of the downward motion of the key. The key position signal is supplied to a digital signal processor, and a music data code is formed on the basis of the key position signal. The music data code is supplied from the digital signal processor to a tone generator, and the tone generator tailors an audio signal. The audio signal is supplied to a speaker system, and the speaker system produces an electronic sound from the audio signal. The resilient force is simply exerted on the key moved between the rest position and the end position, and the player feels the load constant.

The acoustic piano also has a keyboard consisting of black keys and white keys, and the black/white keys are linked with key action mechanisms for driving hammers. When a players depresses a black/white key, the depressed key actuates the associated key action mechanism. The key action mechanism rotates the hammer toward a set of strings, and the hammer suddenly escapes from the key action mechanism on the way toward the set of strings. The hammer starts a free rotation, and strikes the set of strings. The player firstly feels the key heavy, and notices the key suddenly become light at the escape of the hammer. Thus, the key touch of the acoustic piano is quite different from that of the electronic keyboard.

When the musician usually playing the acoustic piano fingers on the keys of the electronic keyboard, he feels the key touch unusual, and may look back the key touch of the acoustic piano with nostalgia. For this reason, various key touch generators have been proposed.

Japanese Patent Publication of Unexamined Application No. 4-204697 discloses a key touch generator comprising a memory storing a series of load data, a key sensor monitoring a key movable between a rest position and an end position and a solenoid-operated key actuator exerting the load on the key. The key touch generator disclosed in the Japanese Patent Publication of Unexamined Application is hereinbelow referred to as "first prior art key touch generator". The series of load data is representative of load variable with a current key position on the way from the rest position to the end position, and the variation of the load data is matched with the variation of the resistance against the finger of a player. The solenoid-operated key actuator generates the electromagnetic force, and the magnitude of the electromagnetic force is variable with the magnitude of a driving current signal. The series of load data is sequentially read out from the memory in response to the current key position, and the magnitude of the driving current signal is varied in dependence on the load data. For this reason, the solenoid-operated actuator exerts the variable load on the depressed key, and the player feels the variation of the resistance like the piano key touch.

Japanese Patent Publication of Unexamined Application No. 7-111631 discloses another key touch generator similar to that of Japanese Patent Publication of Unexamined Application No. 4-204697. The key touch generator disclosed therein is hereinbelow referred to as "second prior art key touch generator". Although the first prior art key touch generator determines the load to be exerted on the depressed key on the basis of the current key position, the second prior art key touch generator determines the magnitude of the load to be exerted on the depressed key on the basis of two physical quantities such as the key position, the key velocity, the acceleration of the depressed key and the force actually exerted on the depressed key. The magnitude of the driving current signal is also varied with the two physical quantities, and the solenoid-operated actuator causes the player to feel the resistance against the key motion like the key touch of an acoustic piano.

Japanese Patent Publication of Unexamined Application No. 7-99475 discloses the third prior art key touch generator. The third prior art key touch generator is implemented by an induction type electromagnetic repulsion generator. A magnetic field generator is attached to one of a key and a key supporting member, and a conductive member is attached to the other of the key and the key supporting member. When the key is depressed, repulsion is electromagnetically generated therebetween, and the player feels the repulsion as the resistance against the key motion.

The solenoid operated actuator unit incorporated in the first prior art key touch generator unidirectionally exerts the electromagnetic force on the plunger and, accordingly, the depressed key. However, the key touch of the acoustic piano is hardly reproduced by the unidirectional solenoid operated actuator. For this reason, the first prior art key touch generator merely reproduces a key touch rather close to an acoustic piano than an electronic keyboard.

The second prior art key touch generator is equipped with a bi-directional solenoid operated actuator unit. The plunger is bi-directionally controlled with a pair of solenoid coils, and the key touch is much closer to that of the acoustic piano. However, a standard keyboard musical instrument has eighty-eight keys, and eighty-eight bi-directional solenoid operated actuator units are required for the eighty-eight keys. A pair of solenoid coils is incorporated in each bi-directional solenoid operated actuator unit, and the eighty-eight bi-directional solenoid operated actuator units occupy large space. For this reason, the second prior art key touch generator makes the keyboard musical instrument large, heavy and costly.

The third prior art key touch generator encounters a problem in that the induction type electromagnetic repulsion generator can not promptly respond to the control data, and hardly reproduces the key touch like the acoustic piano.

SUMMARY OF THE INVENTION

It is therefore an important object of the present invention to provide a keyboard musical instrument a key touch generator of which is light, compact and economical and precisely reproduces a key touch of an acoustic piano.

To accomplish the object, the present invention proposes to offer a resistance against a motion of a movable member through friction produced by a braking unit.

In accordance with one aspect of the present invention, there is provided a keyboard musical instrument for generating a sound, comprising: a movable member supported by a stationary member, and manipulated by a player for specifying an attribute of the sound; a sound generating system responsive to a motion of the movable member so as to produce the sound with the attribute; and a touch generating system including a braking unit having a first member fixed to the movable member, a second member stationary with respect to the stationary member and an actuator pressing the first member and the second member to each other so as to produce a friction therebetween, and a controller causing the actuator to vary the friction so as to offer a resistance against the motion of the movable member.

The movable member may be a key or a pedal.

In accordance with another aspect of the present invention, there is provided a resistance generator provided for a mechanism having a first member movable with respect to a second member, comprising: a third member fixed to said first member; a fourth member stationary with respect to said second member; a sensor monitoring said first member, and producing a piece of status information representative of current status of said first member; an actuator responsive to an instruction representative of a force for pressing said third member and said fourth member to each other so as to vary a friction therebetween; and a controller responsive to said piece of status information so as to change said force represented by said instruction.

The resistance generator may be used in a keyboard musical instrument.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
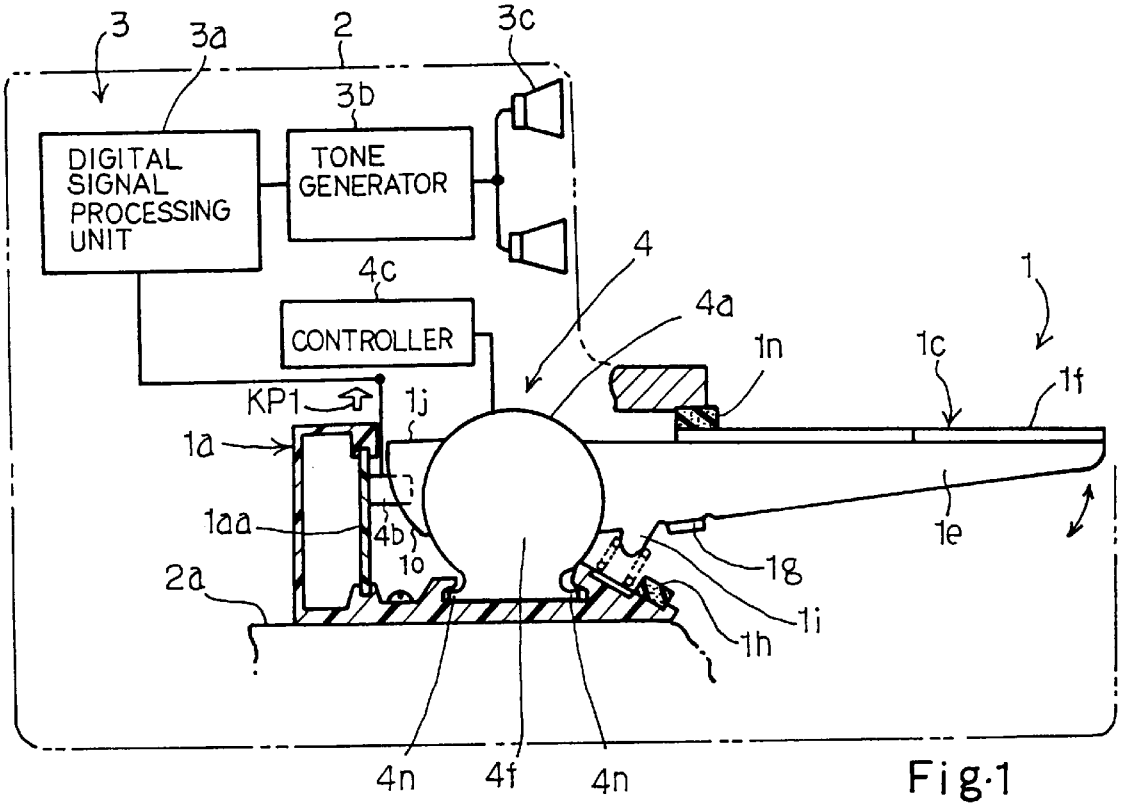
FIG. 1 is a schematic side view showing an electronic keyboard instrument according to the present invention.

Referring first to FIG. 1 of the drawings, an electronic keyboard instrument embodying the present invention largely comprises a keyboard 1 exposed to an open area of a case, an electronic sound generating system 3 and a key touch generator 4. In the following description, term "front" is indicative of a position closer to a player fingering on the keyboard than "rear" position. Term "lateral" means a direction perpendicular to the line drawn between a front position and a rear position.

Figure 2:
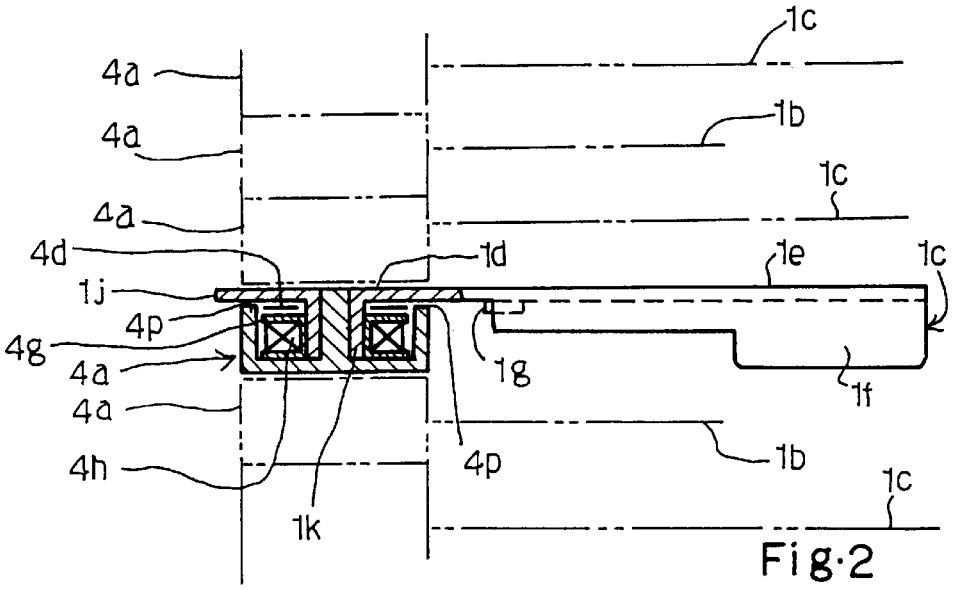
FIG. 2 is a partially-cut-away plan view showing a keyboard incorporated in the electronic keyboard instrument.
Figure 3:
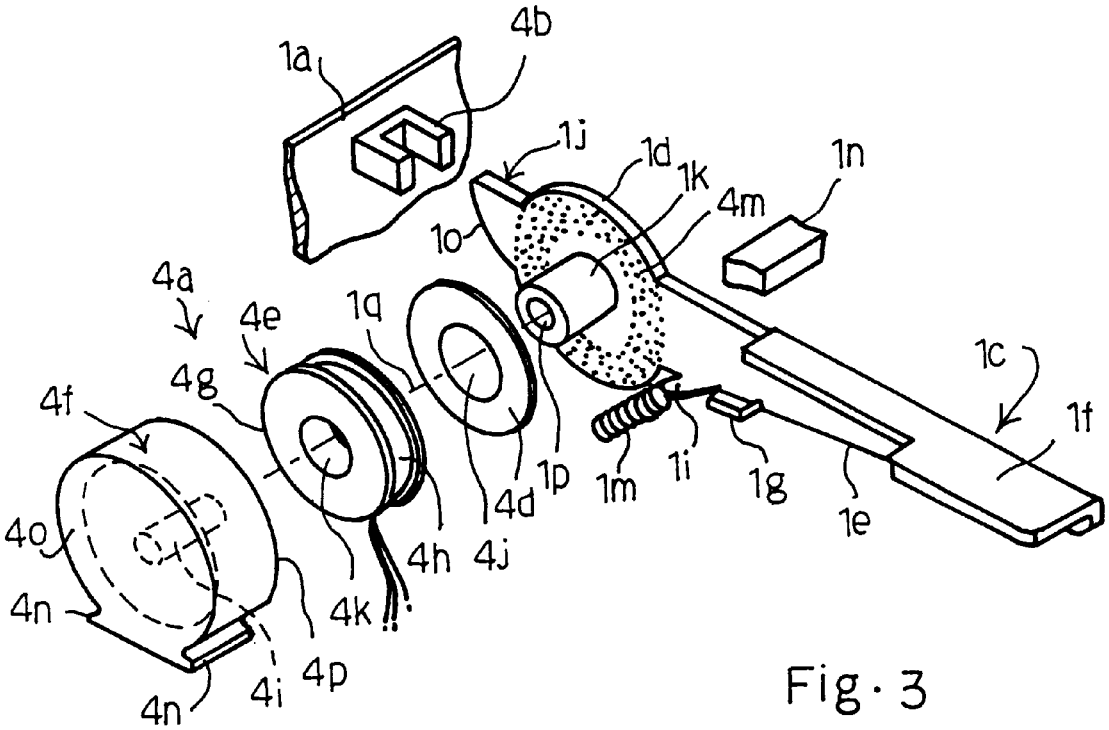
FIG. 3 is a fragmentary perspective view showing a key assembled with an electromagnetic disk braking unit incorporated in the electronic keyboard instrument.

The keyboard 1 includes a bracket member 1*a*, a plurality of black keys 1*b* and a plurality of white keys 1*c* arranged in a similar manner to the keyboard of an acoustic piano as shown in FIG. 2. The bracket member 1*a* is shared between the black/white keys 1*b*/1*c*, and turnably supports the black/white keys 1*b*/1*c*. Each of the black/white keys 1*b*/1*c* turns between a rest position and an end position. The bracket member 1*a* is bolted to a frame 2*a* of the case. Although the black keys 1*a* are different in length from the white keys 1*b*, the black/white keys 1*b*/1*c* are similarly assembled with electromagnetic braking units 4*a* of the key touch generator 4, and description is made on one of the white keys 1*b* with reference to FIG. 3.

The white key has a disc portion 1*d*, a lever portion 1*e* projecting from the disc portion 1*d*, a touch surface portion 1*f* connected to the upper edge of the lever portion 1*e*, a stopper portion 1*g* brought into contact with a key end felt member 1*h* attached to the bracket member 1*a* at the end position, a lower projection 1*i*, a shutter portion 1*j* rearwardly projecting from the disc portion 1*d* and a boss portion 1*k* laterally projecting from the disc portion 1*d*.

A coil spring 1*m* is inserted between the bracket member 1*a* and the lower projection 1*i*, and the white key 1*c* is urged toward the rest position. The rear surface of the touch surface portion 1*f* is brought into contact with a key rest felt member 1*n* attached to the case 2 at the rest position, and the front surface of the touch surface portion 1*f* is depressed by a player.

The shutter portion 1*j* has a sectoral configuration, and the curved rear edge 1*o* is smaller in radius of curvature than the disc portion 1*d*. In other words, when a point is upwardly moved along the curved rear edge 1*o*, the horizontal distance between the point and a corresponding point on the disc portion 1*d* is increased. The shutter portion 1*j* cooperates with a key sensor 4*b* so as to generate a key position signal KP1 indicative of a current position of the white key 1*c* on the trajectory between the rest position and the end position.

The boss portion 1*k* has a hole 1*p*, and provides an axis 1*q* of rotation to the white key 1*c*. When a player depresses the touch surface portion 1*f*, the white key 1*c* turns around the axis 1*q* of rotation.

The white key 1*c* is formed of synthetic resin except for the disc portion 1*d*. The disc portion 1*d* is formed of magnetic substance, and is assembled with the lever portion 1*e*. Otherwise, the white key 1*c* is formed of synthetic resin, and the magnetic disc portion 1*d* is attached to one side surface of the lever portion 1*e*.

The electronic sound generating system 3 includes the key sensors 4*b* for producing the key position signals KP1, a digital signal processing unit 3*a* accompanied with an analog-to-digital converter, a tone generator 3*b* and speakers 3*c*. The electronic sound generating system 3 is similar to that of the prior art electronic keyboard instrument. Namely, when a player depresses one of the black/white keys 1*b*/1*c*, the key position signal KP1 is supplied to the digital signal processing unit 3*a*, and a music data code is formed on the basis of the key position signal KP1. The music data code is supplied from the digital signal processing unit 3*a* to a tone generator 3*b*, and the tone generator 3*b* tailors an audio signal. The audio signal is supplied to the speakers 3*c*, and the speakers 3*c* produce an electronic sound from the audio signal.

The key touch generator 4 includes the electromagnetic braking units 4*a* respectively associated with the black/white keys 1*b*/1*c*, the key sensors 4*b* also associated with the black/white keys 1*b*/1*c* and a controller 4*c*. The key sensors 4*b* are attached to a sensor sheet 1*aa* at intervals, and are implemented by photo-interrupters accompanied with a current-to-voltage converter. The electromagnetic braking unit 4*a* is detailed with reference to FIG. 3.

The electromagnetic braking unit 4*a* includes the disc portion 1*d* of the magnetic substance, a protective sheet 4*d* and an electromagnetic actuator 4*e*, and a stator yoke 4*f*, a bobbin 4*g* and a coil 4*h* form in combination the electromagnetic actuator 4*e*. The coil 4*h* is wound on the bobbin 4*g*, and the coil 4*h* and the bobbin 4*g* as a whole constitute a solenoid coil. The protective sheet 4*d* prevents the bobbin 4*g* and the coil 4*h* wound thereon from the rotation of the disc portion 1*d*, and allows the white key 1*c* to smoothly turn. For this reason, the protective sheet 4*d* is as large in diameter as the bobbin 4*g* or slightly smaller than the bobbin 4*g*.

The protective sheet 4*d* and the bobbin 4*g* are shaped into ring configurations, and the stator yoke 4*f* and a pin member 4*i* define a ring-shaped hollow space. The boss portion 1*k* is inserted into the hollow space 4*j* of the protective sheet 4*d* and the hollow space 4*k* of the bobbin 4*g*, and the pin member 4*i* is inserted into the hole 1*p*. As a result, the bobbin 4*g* and the protective sheet 4*d* are accommodated in the ring-shaped hollow space, and the ring-shaped hollow space is closed by means of the disc portion 1*d*. When the electromagnetic braking unit 4*a* is assembled with the white key 1*c*, the center axis of the pin member 4*i* is aligned with the axis 1*q* of rotation, and the white key 1*c* turns around the pin member 4*i*.

The disc portion 1*d* has a side surface 4*m*, and the side surface 4*m* provides large friction as will be described hereinlater. The stator yoke 4*f* has a pair of edge portions 4*n*, and the edge portions 4*n* are engaged with grooves formed in the bracket member 1*a* (see FIG. 1).

The black/white key 1*b*/1*c* is assembled with the electromagnetic braking unit 4*a* as follows.

The edge portions 4*n* are inserted into the grooves of the bracket member 1*a*, and the stator yoke 4*f* is assembled with the bracket member 1*a*.

On the other hand, the boss portion 1*k* is inserted into the hollow space 4*j* of the protective sheet 4*d* and the hollow space 4*k* of the bobbin 4*g*. Subsequently, the pin member 4*i* is inserted into the hole 1*p*. As a result, the bobbin 4*g*, the coil 4*h* and the protective sheet 4*d* are accommodated in the ring-shaped hollow space defined between the stator yoke 4*f* and the disc portion 1*d*, and the bobbin 4*g* and the coil 4*h* become stationary with respect to the stator yoke 4*f*. The shutter portion 1*j* is inserted into the gap formed in the key sensor 4*b*.

Subsequently, the coil spring 1*m* is inserted between the lower projection 1*j* and the bracket member 1*a*, and the coil spring 1*m* urges the black/white key 1*b*/1*c* in the counter clockwise direction.

When the black/white key 1*b*/1*c* is assembled with the electromagnetic braking unit 4*a*, the side surface 4*m* is opposed to the side surface 4*o* of the stator yoke 4*f*, and extremely narrow gap takes place between the periphery 4*p* of the stator yoke 4*f* and the side surface 4*m* of the disc portion 1*d*. The black/white key 1*b*/1*c* is laterally movable over the narrow gap. However, the lateral movement is so little that a player does not notice it.

Finally, the bracket member 1*a* is bolted to the frame 2*a*, and the black/white keys 1*b*/1*c* assembled with the electromagnetic braking units 4*a* are installed in the case 2.

The black/white key 1*b*/1*c* is turnable between the rest position defined by the key rest felt member 1*n* and the end position defined by the key end felt member 1*h*, and the coil spring 1*m* urges the black/white key 1*b*/1*c* toward the rest position. When a player depresses the black/white key 1*b*/1*c* against the resilient force of the coil spring 1*m*, the black/white key 1*b*/1*c* turns in the clockwise direction, and the key end felt member 1*h* stops the black/white key 1*b*/1*c* at the end position. If the player removes the force from the black/white key 1*b*/1*c*, the coil spring 1*m* urges the black/white key 1*b*/1*c* toward the rest position, and the black/white key 1*b*/1*c* is recovered to the rest position.

The electromagnetic braking unit 4*a* offers the resistance against the key motion as follows. When the coil 4*h* is energized, the coil generates magnetic field looped around the cross section of the bobbin 4*a*, and the stator yoke 4*f* is magnetized. The disc portion 1*d* is attracted to the stator yoke 4*f*, and the side surface 4*m* is brought into contact with the periphery 4*p* of the stator yoke 4*f*. The friction between the side surface 4*m* and the periphery 4*p* offers the resistance against the key motion, and the friction and, accordingly, the resistance are variable with the electromagnetic force in the lateral direction. When the side surface 4*m* is attracted to the periphery 4*p*, the black/white key 1*b*/1*c* is slightly moved in the lateral direction. However, the lateral movement is so little that the player can not notice it. The player recognizes the resistance as a key touch, and the controller 4*c* varies the friction and, accordingly, the resistance.

While the black/white key 1*b*/1*c* is turning between the rest position and the end position, the shutter portion 1*j* intersects the light beam produced by the key sensor 4*b*, and the intersectant area is varied depending upon the current key position on the trajectory between the rest position and the end position. As described hereinbefore, the key sensor 4*b* is implemented by a photo-interrupter, and the amount of current produced therein is variable with the amount of light incident thereon. For this reason, the key sensor 4*b* converts the current key position to the amount of current and, accordingly, the output potential level, and the output potential is supplied through the analog-to-digital converter to the digital signal processing unit 3*a* and the controller 4*c* as the key position signal KP1. Thus, the key position signal KP1 is representative of the current key position. The digital signal processing unit 3*a* determines a key-on timing and a key-off timing, and calculates a key velocity so as to produce music data codes. Though not shown in the drawings, a player selects one of timbres by manipulating a switch array on a board, and the electronic sound generating system 3 imparts the selected timbre to the electronic sound.

Figure 4:
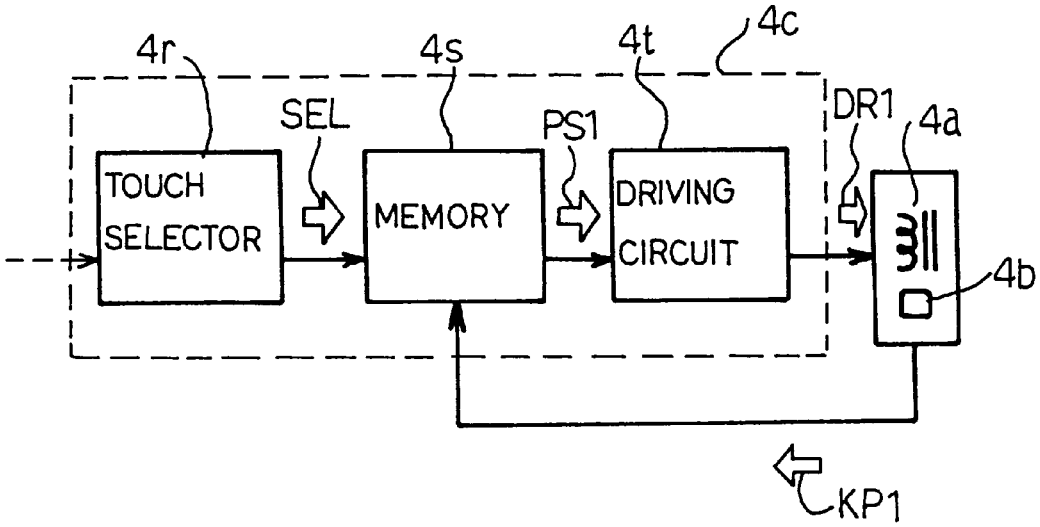
FIG. 4 is a block diagram showing the circuit arrangement of a controller incorporated in the key touch generator.

The key position signal KP is supplied to the controller 4*c* so as to vary the resistance against the key motion. FIG. 4 illustrates the arrangement of the controller 4*c*. The controller 4*c* includes a touch selector 4*r* for selecting one of key touches, a memory 4*s* storing a plurality of key touch tables and a driving circuit for supplying driving signals DR1 to the electromagnetic actuators 4*e*. The controller varies the electromagnetic force by changing the magnitude of the driving signal DR1 so as to change the friction and the resistance as follows.

There are many kinds of keyboard musical instrument such as an acoustic piano, a harpsichord, a celesta, an electronic keyboard instrument and so on, and they are different in key touch. The plurality of key touch tables are corresponding to the key touches of those kinds of keyboard musical instrument. If a player selects the piano key touch, the touch selector 4*r* supplies a selecting signal SEL representative of the piano key touch, and the key touch table for the piano becomes accessible.

Each of the key touch tables stores a series of load data representative of the resistance to be offered to the associated black/white key 1*b*/1*c*. The series of load data represents not only the variation of resistance from the rest position to the end position but also the variation of resistance from the end position to the rest position. When the manufacturer prepares the series of load data, the resilient force of the coil spring 1*m* is taken into account.

The resistance is variable with the current key position, and the series of load data is sequentially read out from the memory 4*s* in response to the key position signal KP1. Thus, the memory 4*s* supplies a load data signal DS1 representative of the load data to the driving circuit 4*t*.

The driving circuit 4*t* is responsive to the load data signal DS1 so as to change the magnitude of the driving signal DR1. The electromagnetic force is proportionally changed together with the magnitude of the driving signal DR1, and the friction and the resistance are varied together with the electromagnetic force. Thus, the controller 4*c* regulates the friction and the resistance to a certain value appropriate for the current key position by changing the magnitude of the driving signal DR1.

Assuming now that the player depresses one of the black/white keys 1*b*/1*c*, the black/white key 1*b*/1*c* turns around the axis 1*q* of rotation in the clockwise direction along the trajectory. The key sensor 4*b* monitors the depressed black/white key 1*b*/1*c*, and reports the current key position to the memory 4*s*. The series of load data is read out from the memory 4*s* in response to the key position signal KP1, and the driving circuit 4*t* regulates the driving signal DR1 to the magnitude corresponding to the load data. The coil 4*h* is energized with the driving signal DR1, and the electromagnetic force is generated in the lateral direction. The side surface 4*m* is attracted to the stator yoke 4*f*, and the friction takes place therebetween.

The read-out load data is varied depending upon the current key position, and, accordingly, the driving circuit 4*t* varies the magnitude of the driving signal DR1 accordingly. As a result, the electromagnetic actuator 4*e* varies the electromagnetic force along the trajectory of the black/white key 1*b*/1*c*, and the electromagnetic braking unit 4*a* changes the resistance against the key motion like the key touch of the selected keyboard musical instrument. The player feels the key touch identical with the key touch of the selected keyboard musical instrument.

The player releases the black/white key 1*b*/1*c* at the end position. The black/white key 1*b*/1*c* returns to the rest position. The key sensor 4*b* informs the memory 4*s* of the current key position on the way from the end position to the rest position. The memory 4*s* supplies the load data to the driving circuit 4*t* in response to the current key position, and the driving circuit 4*t* varies the magnitude of the driving signal DR1 along the trajectory. The electromagnetic actuator 4*e* changes the friction and the resistance, and the player feels the key touch like that of the selected keyboard musical instrument.

In this instance, the black/white key 1*b*/1*c* serves as the movable member, and the first member and the second member are implemented by the side surface 4*m* and the periphery 4*p*, respectively.

As will be appreciated from the foregoing description, only one electromagnetic actuator 4*e* offers the resistance against the key motion not only from the rest position to the end position but also from the end position to the rest position, and the electromagnetic braking unit is light, compact and economical. Moreover, the electromagnetic actuator promptly changes the electromagnetic force and the friction so as to exactly offer the selected key touch.

Second Embodiment

Figure 5:
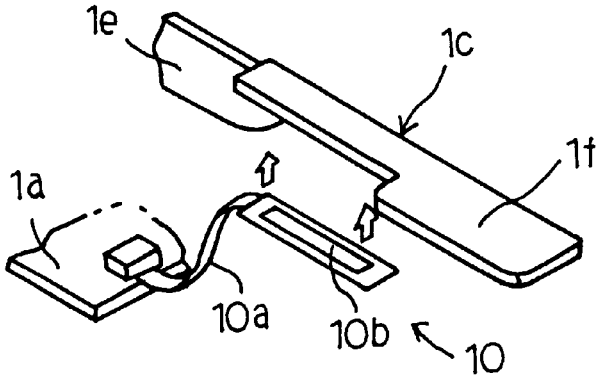
FIG. 5 is a perspective view showing a key sensor incorporated in another electronic keyboard instrument according to the present invention.
Figure 6:
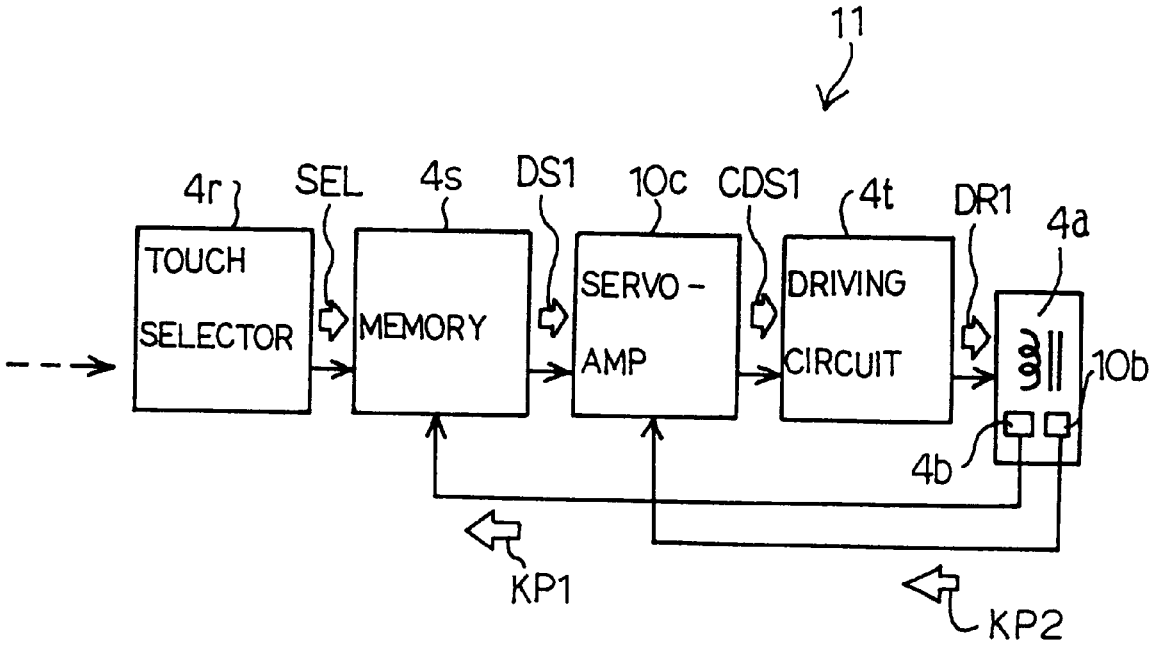
FIG. 6 is a block diagram showing the controller connected to the key sensor.

Another keyboard musical instrument embodying the present invention is similar to the first embodiment except for a servo-controller 10. Description is focused on the servo-controller 10 with reference to FIGS. 5 and 6, and the other components are labeled with the same references designating corresponding components of the first embodiment without detailed description.

The servo-controller 10 includes a resilient member 10*a* fixed to the bracket member 1*a* under each of the black/white keys 1*b*/1*c*, a strain gauge unit 10*b* attached to the upper surface of the resilient member 10*a* and a servo-amplifier 10*c*. When a player depresses the black/white key 1*b*/1*c*, the black/white key 1*b*/1*c* is downwardly moved, and deforms the resilient member 10*a*. The strain gauge unit 10*b* generates a servo-control signal KP2 representative of a current key position, and the servo-control signal KP2 is supplied to a servo-amplifier 10*c*.

The servo-amplifier 10*c* is connected between the memory 4*s* and the driving circuit 4*t*, and compares the current key position estimated from the load data and the current key position represented by the servo-control signal KP2. If the current key position estimated from the load data is matched with the current key position represented by the servo-control signal KP2, the servo-amplifier 10*c* supplies the data signal DS1 without a correction to the driving circuit 4*t*. However, if the current key position estimated from the load data is different from the current key position represented by the servo-control signal KP2, the servo-amplifier 10*c* corrects the load data, and supplies a corrected data signal CDS1 representative of the corrected load data to the driving circuit 4*t*. Thus, the servo-controller 10 enhances the reliability of the load data, and causes the electromagnetic braking unit 4*a* to offer the resistance exactly matched with the resistance against the key motion of a selected keyboard musical instrument.

Figure 7:
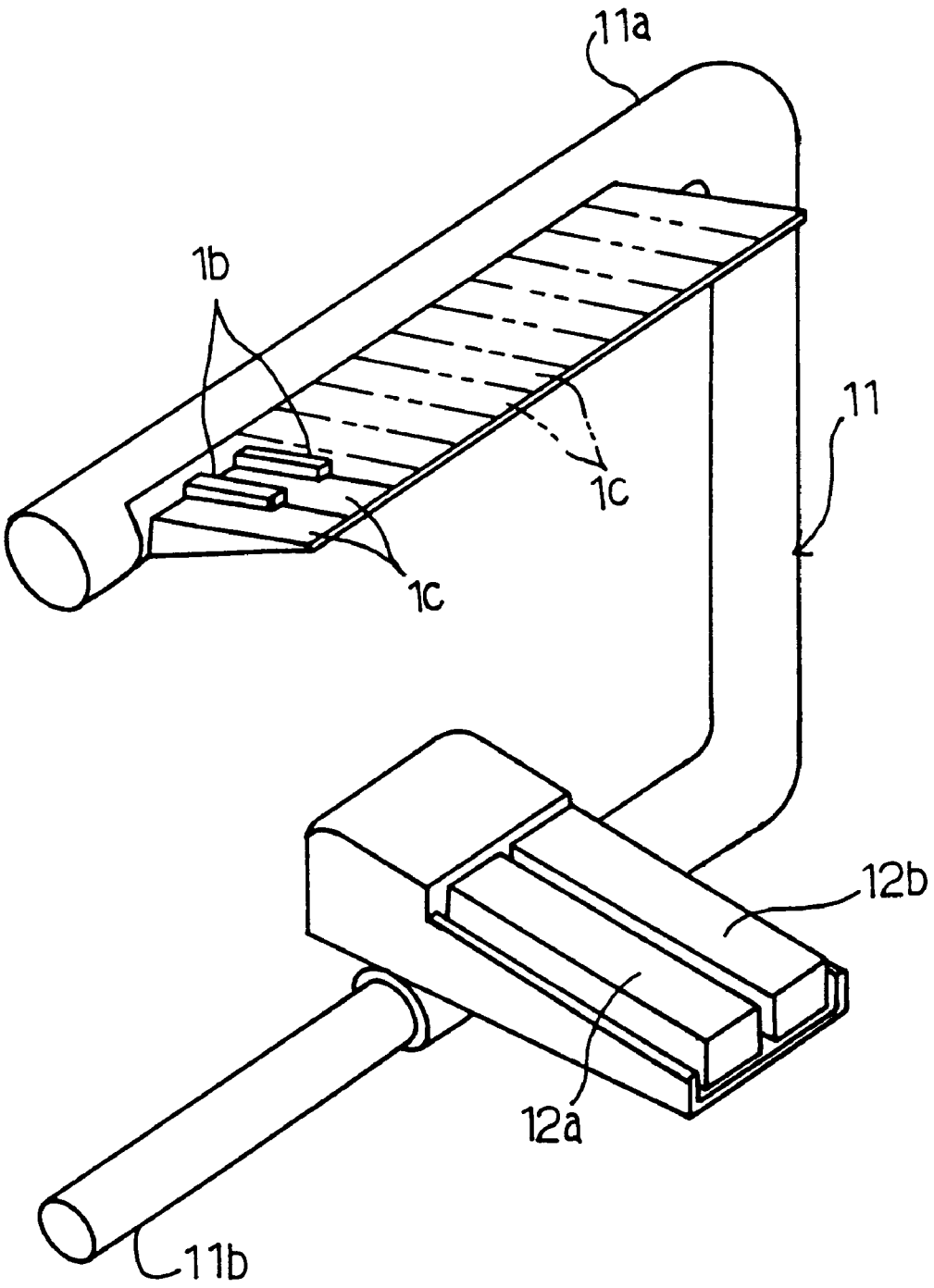
FIG. 7 is a perspective view showing the structure of the keyboard musical instrument.

FIG. 7 illustrates the keyboard musical instrument implementing the second embodiment. A pipe 11 is bent twice so as to have an upper lateral bar 11*a* and a lower lateral bar 11*b*. The electromagnetic braking units 4*a* are accommodated in an inner space of the upper lateral bar 11*a*, and the black/white keys 1*b*/1*c* project from the upper lateral bar 11*a*. A pair of pedals 12*a*/12*b* is turnably supported by the lower lateral bar 11*b*, and the electromagnetic braking units 4*a* are provided for the pedals 12*a*/12*b*, respectively. The electromagnetic braking units for the pedals 12*a*/12*b* are connected to a controller (not shown), and the controller varies the magnitude of driving signals so as to offer a pedal touch like that of a selected keyboard musical instrument.

Third Embodiment

Figure 8:
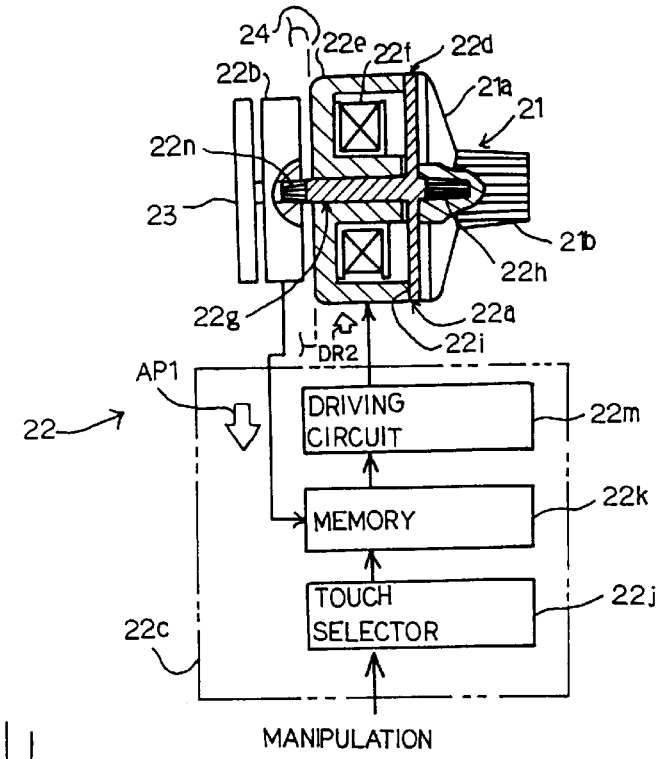
FIG. 8 is a cross sectional view showing a dial accompanied with the electromagnetic braking unit according to the present invention.

Turning to FIG. 8 of the drawings, a dial 21 embodying the present invention is assembled with a touch generating system 22, and a spiral spring 23 urges the dial 21 to rotate in one direction. The dial 21 may be incorporated in a keyboard musical instrument so that a player changes an attribute of sound such as, for example, the volume of the sound or the timbre. However, the dial 21 is not limited to a part of the keyboard musical instrument. The dial 21 may be incorporated in any kind of apparatus such as, for example, a car, a computer system, an industrial machinary, home applications and so on.

The dial 21 has an umbrella-like portion 21*a* and a knob 21*b* integral with the umbrella-like portion 21*a*. An operator pinches the knob 21*b*, and rotates the dial 21 in the other direction.

The touch generating system 22 includes an electronic braking unit 22*a*, an encoder 22*b* and a controlling circuit 22*c*. The encoder 22*b* monitors the dial 21, and determines a current angular position of the dial 21. The encoder produces a detecting signal AP1 representative of the current angular position of the dial 21, and supplies it to the controlling circuit 22*c*. The controlling circuit 22*c* determines a resistance to be offered to the operator on the basis of the current angular position, and varies the magnitude of a driving signal DR2. The driving signal DR2 is supplied to the electromagnetic braking unit 22*a*, and the electromagnetic braking unit 22*a* offers the resistance against the rotation of the dial 21.

The electromagnetic braking unit 22*a* includes a disc-shaped rotor 22*d* formed of magnetic substance, a stator yoke 22*e* fixed to a stationary member 24, a solenoid coil 22*f* accommodated in the stator yoke 22*e* and connected to the controlling circuit 22*c* and a shaft 22*g* integral with the disc-shaped rotor 22*d* and fixed to the disk at one end 22*h*. The shaft 22*g* passes through the stator yoke 22*e* and the encoder 22*b*, and is fixed to the spiral spring 23 at the other end thereof. The spiral spring 23 urges the shaft 22*g* and, accordingly, the dial 21 in one direction, and the operator rotates the dial 21 in the opposite direction against the resilient force of the spiral spring 23.

The periphery 22*i* is slightly spaced from the stator yoke 22*d*, and the dial 21 is smoothly rotated. When the solenoid coil 22*f* is energized with the driving signal DR2, the stator yoke 22*e* is magnetized, and the disc-shaped rotor 22*d* is attracted to the stator yoke 22*e*. Sliding friction takes place between the periphery 22*i* and the stator yoke 22*e*. When the disc-shaped rotor 22*d* is attracted to the stator yoke 22*e*, the dial 21 is slightly moved; however, the gap between the periphery 22*i* and the stator yoke 22*e* is so narrow that the operator does not notice it.

The controlling circuit 22*c* includes a touch selector 22*j* manipulative by an operator, a memory 22*k* storing a plurality of touch tables and a driving circuit 22*m*. The touch selector 22*j*, the memory 22*k* and the driving circuit 22*m* are basically corresponding to those of the first/second embodiment. The plurality of touch tables represent different load pattern to be exerted to the dial 21, and an operator selects one of the touch tables through the touch selector 22*j*. The load pattern stored in one of the touch tables causes the electromagnetic braking unit 22*a* to intermittently offer a resistance against the rotation of the dial 21. The operator feels the dial 21 to click.

A plurality of grooves 22*n* are formed in the shaft 22*g*, and the encoder 22*b* counts the grooves passing in front of itself. The encoder 22*b* determines the current angular position on the basis of the number of grooves and which direction the dial 21 is rotated. The encoder 22*b* reports the current angular position to the memory 22*k*.

The memory 22*k* is responsive to the detecting signal AP1 so as to sequentially supply load data from the selected touch table to the driving circuit 22*m*, and the driving circuit 22*m* changes the magnitude of the driving signal DR2 on the basis of the load data. The solenoid coil 22*f* generates the electromagnetic force in proportional to the magnitude of the driving signal DR2, and the electromagnetic braking unit 22*a* offers the resistance against the rotation of the dial 21. If the operator selects the touch table for the click, the electromagnetic braking unit 22*d* intermittently increases the resistance during the rotation of the dial 21.

Fourth Embodiment

Figure 9:
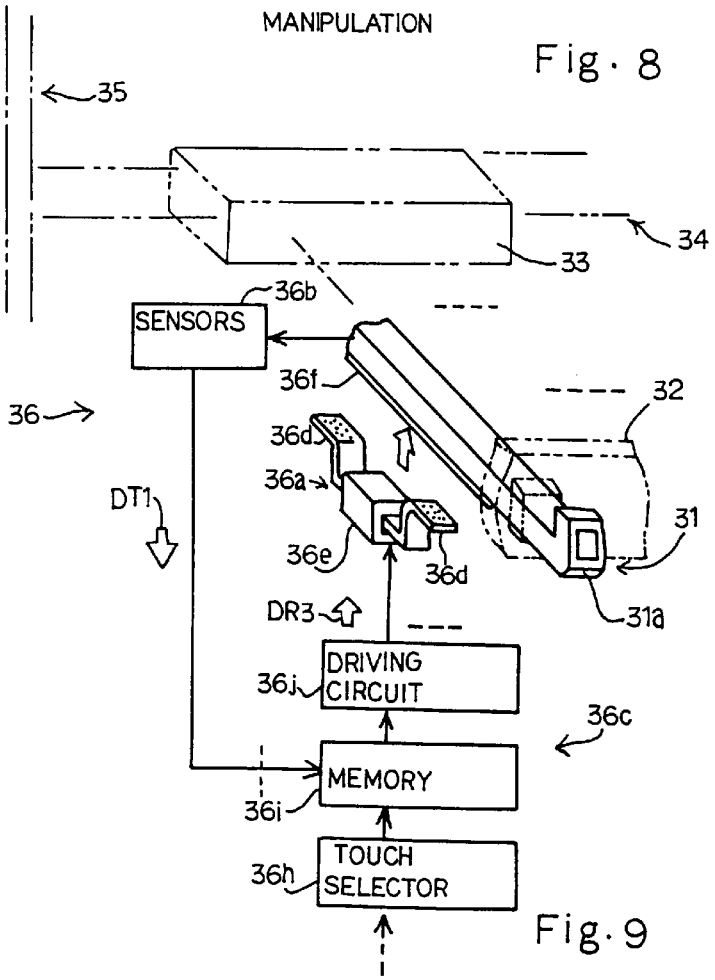
FIG. 9 is a schematic perspective view showing an organ according to the present invention.
Figure 10:
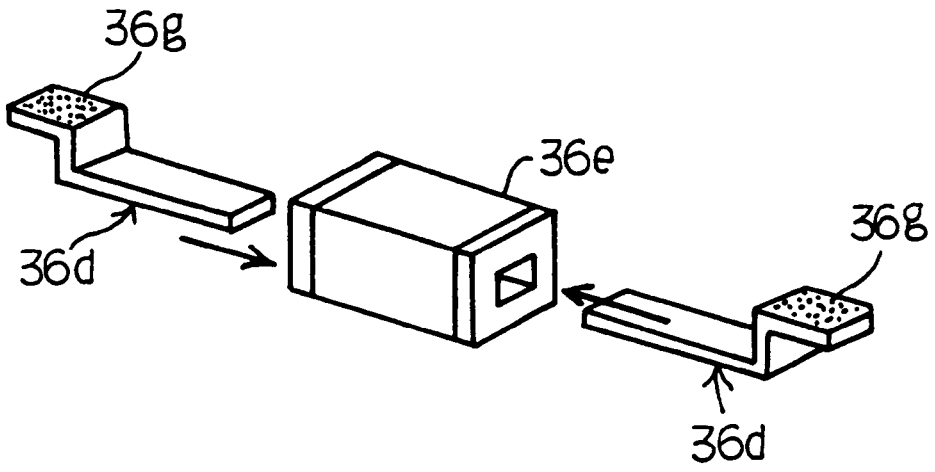
FIG. 10 is a fragmentary view showing an electromagnetic actuator incorporated in the organ.
Figure 11:
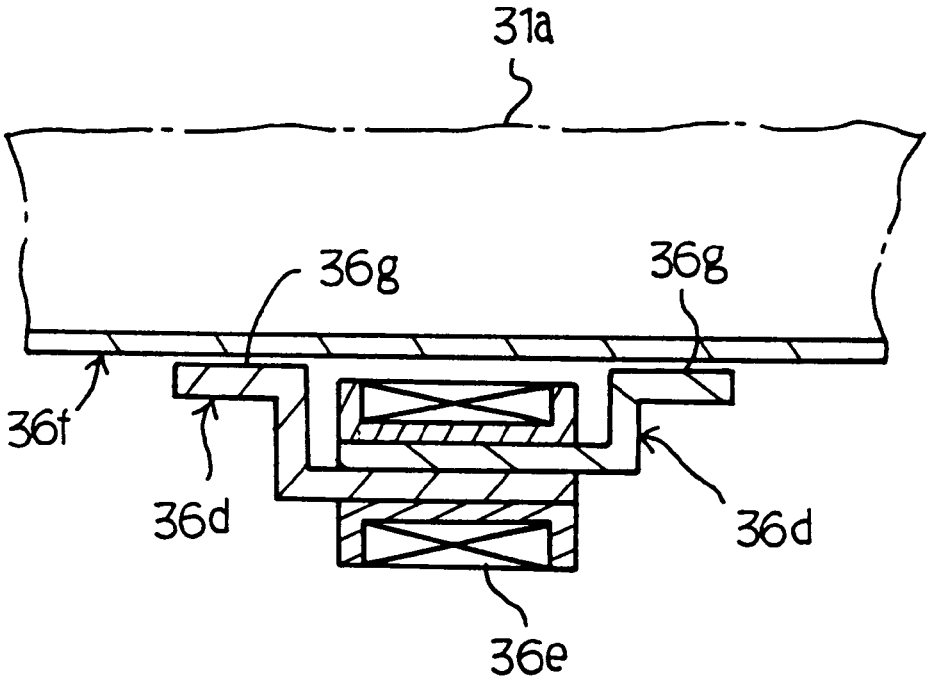
FIG. 11 is a cross sectional view showing the electromagnetic actuator.

FIGS. 9, 10 and 11 illustrate an organ embodying the present invention. The organ has a keyboard 31 implemented by stops 31*a*, and the stops 31*a* are slidable with respect to an enclosure 32. The stops 31*a* have a rectangular cross section, and are connected to an action so as to selectively open and close air passages 34 to pipes 35. When a player pushes the stop 31*a* into the enclosure 32, the stop 31*a* closes the associated air passage 34. On the other hand, when the stop 31*a* is pulled out, the stop 31*a* opens the air passage 34 so as to allow the pipe 35 to sound. Thus, the stop 31*a* is reciprocally moved by the player.

A touch generating system 36 is provided for the stops 31*a*, and includes electromagnetic braking units 36*a* respectively provided under the stops 31*a*, sensors 36*b* monitoring the stops 31*a* so as to provide detecting signals DT1 each representative of a current position of the associated stop 31*a* and a controlling circuit 31 for varying driving signals DR3.

The electromagnetic braking unit 36*a* includes a pair of stator yokes 36*b*, a solenoid coil 36*e* and a braking plate 36*f* of magnetic substance. As shown in FIGS. 10 and 11, the solenoid coil 36*e* has a hollow space, and the pair of stator yokes 36*d* are inserted into the hollow space in such a manner as to be partially overlapped with each other. The stator yokes 36*d* have respective braking surfaces 36*g* closer to the braking plate 36*f* than the solenoid coil 36*e*. The braking plate 36*f* is attached to the lower surface of the stop 31*a*, and is slightly spaced from the braking surfaces 36*g*.

When the solenoid coil 36*e* is energized, the braking plate 36*f* is attracted to the stator yokes 36*d*, and friction takes place therebetween so as to offer a resistance against the sliding motion of the stop 31*a*. Although the stop 31*a* is downwardly moved together with the braking plate 36*f*, the movement is so little that the player does not notice it.

The controlling circuit 36*c* includes a touch selector 36*h* for specifying a load pattern, a memory 36*i* storing a plurality of touch tables representative of different load patterns and a driving circuit 36*j* for varying the magnitude of the driving signal DR3 on the basis of the load data. While a player is pushing the stop 31*a* into the enclosure 32, the load pattern stored in one of the touch tables may cause the electromagnetic braking unit 36*a* to increase the resistance against the sliding motion. Another load pattern may cause the electromagnetic braking unit 36*a* to stepwise change the resistance against the sliding motion of the stop 31*a*.

The load data representative of the load pattern are sequentially read out form the selected touch table to the driving circuit 36*j*, and the driving circuit 36*j* varies the magnitude of the driving signal DR3. The solenoid coil 36*e* changes the electromagnetic force in proportional to the magnitude of the driving signal DR3, and, accordingly, the stator yokes 36*d* and the braking plate 36*f* vary the friction therebetween. Thus, the electromagnetic braking unit 36*a* offers the resistance varied along the stroke of the stop 31*a*.

Fifth Embodiment

Figure 12:
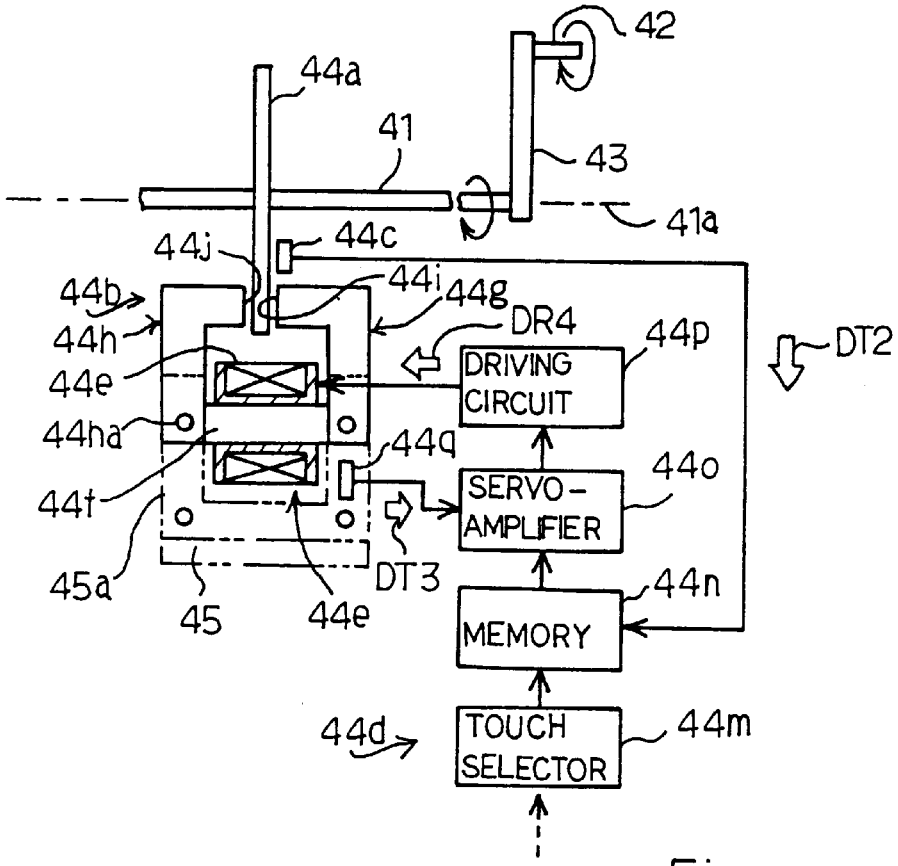
FIG. 12 is a schematic view showing a disc braking system according to the present invention.
Figure 13:
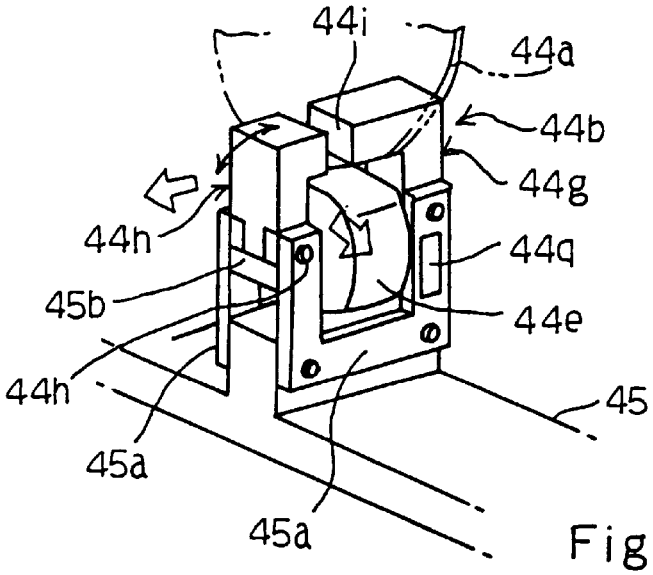
FIG. 13 is a perspective view showing an electromagnetic braking unit incorporated in the disc braking system.

FIGS. 12 and 13 illustrate a disc brake system embodying the present invention. The disc brake system is provided for a shaft member 41, and another shaft member 42 transfers a torque through a transmission unit 43 to the shaft member so as to rotate the shaft member 41 around a center axis 41*a* thereof.

The disc brake system comprises a disc-shaped rotor 44*a* fixed to the shaft member 41, a brake caliper 44*b* connected to a stationary frame 45 by means of a pair of U-letter shaped springs 45*a,* a sensor 44*c* for producing a detecting signal DT2 representative of a current angular position of the disc-shaped rotor 44*a,* a controlling circuit 44*d* producing a driving signal DR4 and a solenoid coil 44*e* attached to the brake caliper 44*b*. When the solenoid coil 44*e* is energized with the driving signal DR4, the brake caliper 44*b* pinches the disc-shaped rotor 44*a,* and offers a resistance against the rotation of the shaft member 41. The U-letter shaped springs 45*a* are connected to each other by means of a pair of rigid members 45*b*, and the U-letter shaped springs 45*a* are resiliently deformed when the brake caliper 44*b* pinches the disc-shaped rotor 44*a*.

The brake caliper 44*b* includes a supporting portion 44*f* for supporting the solenoid coil 44*e,* a stationary arm 44*g* fixed to the supporting portion 44*f* and a movable arm 44*h* turnably connected to the supporting portion 44*f*. The movable arm 44*h* turns around a pin member 44*ha*. The stationary arm 44*g* and the movable arm 44*h* have respective friction surfaces 44*i* and 44*j*, and the friction surfaces 44*i*/44*j* are pressed against the both surfaces of the disc-shaped rotor 44*a*. Though not shown in the drawings, a spring member urges the movable arm in the counter clockwise direction, and a gap takes place between the stationary arm 44*g* and the movable arm 44*h*.

The disc-shaped rotor 44*a* passes through the gap between the stationary arm 44*g* and the movable arm 44*h*. When the solenoid coil 44*e* is energized, the stationary arm 44*g* is magnetized, and the movable arm 44*h* is attracted to the stationary arm 44*g*. Thus, the brake caliper 44*b* pinches the disc-shaped rotor 44*a* between the stationary arm 44*g* and the movable arm 44*h*, and offers the resistance against the rotation of the disc-shaped rotor 44*a*. The braking force is proportional to the electromagnetic force generated by the solenoid coil 44*e* and the stationary arm 44*g*.

The controlling circuit 44*d* includes a touch selector 44*m* for specifying a load pattern, a memory 44*n* storing a plurality of touch tables representative of different load patterns, a servo-amplifier 44*o* for correcting the load to be exerted to the disc-shaped rotor 44*a* and a driving circuit 44*p* for varying the magnitude of the driving signal DR4 on the basis of the load data. A load sensor 44*q* is attached to the U-letter shaped spring 45*a,* and produces a detecting signal representative of the load from the deformation of the U-letter shaped spring 45*a*. The detecting signal DT3 is supplied to the servo-amplifier 44*o*. In this instance, the load sensor 44*q* is implemented by a strain gauge unit.

The load pattern stored in one of the touch tables causes the braking force or the resistance against the rotation of the disc-shaped rotor 44*a* to be linearly increased, and another load pattern causes the braking force to be quadratically increased.

When a user specifies one of the load patterns through the touch selector 44*m*, a series of load data representative of the selected load pattern is sequentially read out from the memory 44*m* in response to the detecting signal DT2, and the servo-amplifier 44*o* compares the load data with the actual load represented by the detecting signal DT3. If the load data is appropriate, the load data is transferred to the driving circuit 44*p*. However, if the load data is different from the actual load, the servo-amplifier 44*o* corrects the load data, and the corrected load data is supplied to the driving circuit 44*p*.

The driving circuit 44*p* varies the magnitude of the driving signal DR4. The solenoid coil 44*e* changes the electromagnetic force in proportional to the magnitude of the driving signal DR4, and, accordingly, the brake caliper 44*h* changes the braking force.

As will be appreciated from the foregoing description, a single actuator causes a movable member and a stationary member to offer a resistance against a bi-directional motion of an object, and the resistance generator is light, compact and economical.

Although particular embodiments of the present invention have been shown and described, it will be obvious to those skilled in the art that various changes and modifications may be made without departing from the spirit and scope of the present invention.

For example, each of the key touch tables may be divided into a plurality of sub-tables for storing different load data. The plurality of sub-tables may be assigned to the respective black/white keys 1*b*/1*c* or key groups.

The series of load data may be read out from the memory in response to a detecting signal representative of a velocity, an acceleration, a force or a combination thereof.

The actuator may be implemented by a mechanical actuator such as a pneumatic actuator or a hydraulic actuator.

What is claimed is:

1. A keyboard musical instrument for generating a sound, comprising:

a movable member supported by a stationary member, and manipulated by a player for specifying an attribute of said sound;

a sound generating system responsive to a motion of said movable member so as to produce said sound with said attribute; and a touch generating system including a braking unit having a first member fixed to said movable member, a second member stationary with respect to said stationary member and an actuator pressing said first member and said second member to each other so as to produce a friction therebetween, and a controller causing said actuator to vary the friction so as to offer a resistance against said motion of said movable member.

2. The keyboard musical instrument as set forth in claim 1, in which said movable member is one of keys depressed and released by said player for specifying a note of a scale.

3. The keyboard musical instrument as set forth in claim 2, in which said one of keys includes a disc portion providing an axis of rotation aligned with a center thereof for said one of keys, a lever portion projecting from said disc portion and a touch surface portion connected to said lever portion which said player depresses and removes a force from, and said first member and said second member are implemented by a magnetic side surface of said disc portion and a stator yoke of said actuator generating electromagnetic force in cooperation with a solenoid coil so as to attract said magnetic side surface to said stator yoke.

4. The keyboard musical instrument as set forth in claim 3, in which said stator yoke has a cylindrical configuration having a ring-shaped periphery where said magnetic side surface of said disc portion is attracted, and said solenoid coil is accommodated in an inner space defined by said stator yoke.

5. The keyboard musical instrument as set forth in claim 4, in which said braking unit further has a protective sheet inserted between said magnetic side surface of said disc portion and said solenoid coil so as to prevent said solenoid coil from friction due to a rotation of said disc portion.

6. The keyboard musical instrument as set forth in claim 3, in which said controller supplies a driving signal to said solenoid coil.

7. The keyboard musical instrument as set forth in claim 6, in which said controller has a sensor monitoring said movable member so as to produce a detecting signal representative of a current position of said movable member, and a controlling circuit responsive to said detecting signal for changing the magnitude of said driving signal.

8. The keyboard musical instrument as set forth in claim 7, in which said sensor is a non-contact sensor.

9. The keyboard musical instrument as set forth in claim 8, in which said non-contact sensor is a photo-sensor.

10. The keyboard musical instrument as set forth in claim 7, in which said controlling circuit has a memory storing at least one key touch table having a series of load data representative of a resistance against said motion of said movable member variable with said current position, a driving circuit responsive to said series of load data read out from said memory in response to said detecting signal so as to vary the magnitude of said driving signal.

11. The keyboard musical instrument as set forth in claim 10, in which said memory further stores another key touch table having another series of load data different from that of said at least one key touch table, and said controlling circuit further has a touch selector manipulated by said player for supplying a selecting signal representative of one of the key touch tables.

12. The keyboard musical instrument as set forth in claim 10, in which said controlling circuit further has a servo-amplifier connected between said memory and said driving circuit and responsive to a servo-controlling signal supplied from another key sensor provided for said movable member to see whether or not said load data exactly represents said current key position, said servo-amplifier supplying a corrected load data when said load data does not correctly represent said current key position.

13. The keyboard musical instrument as set forth in claim 1, in which said movable member is a stop slidable into and out of an enclosure serving as said stationary member for specifying a note of a scale.

14. The keyboard musical instrument as set forth in claim 13, in which said first member is formed of magnetic substance, and said second member is a stator yoke cooperating with a solenoid coil so as to generate electromagnetic force for attracting said first member to said stator yoke.

15. A resistance generator provided for a mechanism having a first member movable with respect to a second member, comprising:

a third member fixed to said first member;

a fourth member stationary with respect to said second member;

a sensor monitoring said first member, and producing a piece of status information representative of current status of said first member;

an actuator responsive to an instruction representative of a force for pressing said third member and said fourth member to each other so as to vary a friction therebetween; and a controller responsive to said piece of status information so as to change said force represented by said instruction.

16. The resistance generator as set forth in claim 15, in which said first member is rotatable with respect to said second member, and said third member is formed of magnetic substance so as to be electromagnetically attracted to said fourth member serving as a stator yoke cooperate with a solenoid coil serving as said actuator.

17. The resistance generator as set forth in claim 15, in which said first member is a dial.

18. The resistance generator as set forth in claim 15, in which said first member is a disc-shaped rotor.

19. The resistance generator as set forth in claim 15, further comprising another detector for detecting another piece of status information, and said controller compares said piece of status information with said another piece of status information so as to correct said force when said piece of status information is different from said another piece of status information.

* * * * *